106-90 AU 114 EX
3/13/84 4,436,556

United States Patent [19]
Kadelka

[11] 4,436,556
[45] Mar. 13, 1984

[54] PROCESS FOR CONSOLIDATING SOIL AND FROST PROTECTION LAYERS PRODUCED THEREBY

[75] Inventor: Friedrich Kadelka, Bad Segeberg, Fed. Rep. of Germany

[73] Assignee: Chemische Fabrik Grunau GmbH, Illertissen, Fed. Rep. of Germany

[21] Appl. No.: 286,678

[22] Filed: Jul. 24, 1981

[30] Foreign Application Priority Data

Jul. 29, 1980 [DE] Fed. Rep. of Germany ..... 3028670

[51] Int. Cl.³ ..... C04B 7/35
[52] U.S. Cl. ..... 106/90; 106/97; 106/900; 106/DIG. 1; 405/266
[58] Field of Search ..... 106/90, 97, DIG. 1, 106/900; 405/266

[56] References Cited

U.S. PATENT DOCUMENTS

| | | | |
|---|---|---|---|
| 3,788,868 | 1/1974 | Kitsuda et al. | 106/97 |
| 4,116,705 | 9/1978 | Chappell | 106/DIG. 1 |
| 4,129,449 | 12/1978 | Kojima | 405/266 |
| 4,225,359 | 9/1980 | Schneider | 106/900 |
| 4,266,980 | 5/1981 | Chudo et al. | 106/97 |
| 4,274,880 | 6/1981 | Chappell | 106/97 |
| 4,299,516 | 11/1981 | Miyoshi et al. | 106/97 |
| 4,306,910 | 12/1981 | Miyoshi et al. | 106/97 |

*Primary Examiner*—James Poer
*Attorney, Agent, or Firm*—Cushman, Darby & Cushman

[57] ABSTRACT

There is described a process for the consolidation of soil in which the moisture containing soil to be consolidated, rubbish or a soil/rubbish mixture is mixed with cement and then compacted. A fluidizing agent is added to the composition to be consolidated.

25 Claims, 5 Drawing Figures

PROCESS FOR CONSOLIDATING SOIL AND FROST PROTECTION LAYERS PRODUCED THEREBY

BACKGROUND OF THE INVENTION

The invention is directed to a process of consolidating soil as well as the frost protective layers produced thereby as subsoil or substructure for roads and railroad construction.

In building roads and railroad lines customarily before applying the road surface (top of the road) or applying the road bed in railroad construction the subsoil or substructure is solidified. Today this occurs according to a process known as soil consolidation in which the different soils (loose compositions) as for example soil according to DIN 18196 (German Industrial Standard 18196), pulverulent mineral materials or mixtures of the same are treated with water and cement, for example blended with soil pulverizers or in mixing plants and then are compacted by the action of rolls, for example by means of rubberized rolls. Through the hardening of the cement contained in the soil consolidating composition the individual particles of the soil consolidating composition are united to a solid cemented framework. While the particles are practically completely enclosed in the cement stone of concrete, in soil consolidation the particles are cemented only at individual points. Hence very much higher compression strengths are sought with concrete and correspondingly more cement is added than is necessary with soil consolidation where depending on the soil one manages with 80 to 220 kg of cement per $m^3$ (corresponding to 4 to 16% cement). Under the above mentioned pulverulent mineral materials which below and in the patent claims for short are designated by the term "rubbish" there is understood natural and synthetic mineral materials such as fly ash, combustion residues, other pulverulent or fine sand containing residues from dry, wet and electro dust removing plants, silt and clay containing wash residues from grit and quarry stone plants, rubbish materials from grinding processes and other finely divided inorganic and organic residues of any type.

Because of the different purposes and the different materials employed there are basic technological differences between the consolidation of soil with cement and the manufacture of concrete. While with concrete (cement concrete) there is always assumed a practically complete compression so that the hollow spaces between the individual grit and sand particles are nearly completely filled with cement glue, in the soil consolidation there is not produced a practically complete compression.

Therefore with concrete (except for the quality of the cement) the quality is determined by the cement glue, i.e. the water cement value and the porosity of the hardened cement stone dependent thereon. In contrast with soil solidification there cannot be placed any particular requirements aiming at a minimum of hollow space. Even with good compression therefore in soil solidification there remains in the particle framework more hollow space than in concrete: While concrete usually strives for a residual pore or void content of approximately 2.0 volume % or less and only in exceptional cases as in road concrete seeks a total pore content of about 4 vol %, the pore or void portion in soil solidification is 10 to 20 times greater.

The production of compositions for the solidification of soil with cement therefore in contrast to the production of concrete takes place according to other principles, namely those of soil mechanics. This starts from a system of solids as well as water and air as the voids. Basically there is attempted to attain a highest arrangement of mineral material according to the rule: the larger a mass per unit of volume, the more is the resistance to deformation. Accordingly the essential determining factors for the quality of soil solidification with cement are the water content, the cement content and the extent of compression.

There can be used for the solidification of soil with cement any of the soils occurring in nature which can be comminuted to the required degree, do not contain any materials disturbing hardening and are miscible with cement (hydrophobized or not hydrophobized) and water as well as in a given case suitable additives. Thereby the particle size distribution of the soil to be solidified follows a course far above (or outside) the sieve lines noted for cement concrete (according to DIN 1045). Water and cement behave here in no water cement value ratios similar tot hose of concrete technology.

Accordingly there is no possibility to calculate "steady" fixed tensile strength properties in the soil solidification with cement.

As has already been mentioned above the consolidation can take place with the mixing in of rubbish or, as already carried out experimentally with exclusive use of rubbish such as fly ash. In this case there is likewise valid essentially the previously mentioned point of view.

The water in the solidified soil-cement mixture acts as "lubricant". Accordingly there is for each soil, rubbish, or soil/rubbish mixture or for each soil-cement mixture, soil-rubbish-cement mixture or rubbish-cement mixture from the viewpoint of the above mathematical interrelationship a so-called "optimal water content", which is ascertained in the so-called Proctor experiment (see the pamphlet DIN 18127 for the Proctor experiment, published by the Forschungsgesellschaft fur das Strassenwesen). Hereby on principle there is employed dry soil-cement mixture (or the other mixtures previously mentioned), to which there is added increasing amounts of water. Each mineralwater mixture is then struck with fixed blows of a normalized compression hammer in the Proctor pot. Each experiment permits the determination for each Proctor pot charge a so-called moist space density. After the determination of moisture there is calculated from the moist space density a dry space density whereby the highest dry space density is calculated at the optimal water content. This can be determined in most cases with about five individual experiments. If there is plotted the determined dry space densities (ordinate) against the water contents corresponding thereto then there is frequently attained a curve similar to the Gaussian distribution. There can be derived from this type of curve that for the production of the highest dry-space density in each case considering a compression energy in Proctor pot of about 0.6 $Mn/m^3$, there is a specific water content.

Since there are no sieve lines similar to the concrete fcr consolidating soil the mineral hollow space in the Proctor process is determined in the manner where the highest dry space-density for the so-called "raw density" is placed in the ratio. From a dry-space density of e.g. 1.90 $kg/dm^3$ and a raw density of 2.65 $kg/dm^3$ there is calculated for the mixture a mineral hollow space of:

$$100 \times \left(1 - \frac{\text{dry space density}}{\text{raw density}}\right) = \text{about } 28.3 \text{ vol. \%}$$

While a concrete, as already mentioned, merely has about 2.0 vol. % of pores or voids the mineral hollow space for soil consolidation with cement fluctuates in a wide range between about 20 and 40 vol. %.

The water requirement in the soil consolidation, thus corresponds to the "optimal water content", which, as described above, can be ascertained according to the laws of soil mechanics. The dry space density (Proctor density) corresponding to this optimal water content is generally also sought in the design of the structure, assuming that the results of the Proctor test in the associated production of sample cylinders confirm for the determination of the required or suitable cement content for attaining the necessary compression strength.

The above described Proctor test likewise serves for the production and investigation of sample bodies. For this purpose with the previously ascertained optimal water content mixtures of soil, cement and water were produced in such manner that the cement content generally is varied in three steps, e.g. 5%, 7% and 9% cement. After the body formed in the Proctor test has been extruded from the mold it is investigated according to specified processes at 7 and/or 28 days after its production fcr compression strength (see TVV 74, Bundesminister fur Verkehr, Abt. Strassenbau, West Germany). Hereby the increase in strength is in somewhat linear relationship with the increase of the cement content. There is connected interpolation from a compression strength which is reached to the cement requirement interrelated therewith (see "Beton" 19 (1969), pages 19 to 24).

There is no relationship in soil consolidation between strength properties and water cement value as is the case with concrete. The use of specific types of cement and classes of cement material is frequently greatly limited in soil consolidation on account of special concerns. For example because of the desired quick hardening of a soil consolidation customarily there is used a correspondingly quick hardening cement. Preferably there is used as suitable cement for soil solidification normal Portland cement PZ35F (according to DIN 1164) as well as hydrophobized special cements formed therefrom as for example Pectacrete-cement.

As already mentioned the processing of the soil consolidation compositions (construction mixing or central mixing process) thoroughly mixed by soil pulverizers or incorporated by road finishers takes place for example through the action of rolls by means of rubberized rolls. Under a static roll load of about 10 tons (the tons throughout the specification and claims are metric tons) by multiple passages of the rolls the solid particles are compressed to such an extent that the dry density ascertained in the Proctor test is nearly reached or even is partially considerably exceeded. A statement of the consistency in soil consolidation compositions is unnecessary because there are in each case only "damp" and therewith generally drier than a comparable concrete of about the consistency $K_1$. There is no such thing as a so-called "optimum compression" in soil consolidation as there is with concrete since the degree of compression always conforms to the "Proctor density" determined from the same composition, i.e. the highest dry-space density in the Proctor process.

Although the soil consolidation with cement shows a considerable improvement of the properties of the subsoil or substructure, especially in regard to the resistance to frost in building roads and railroads, this process, however, also has various disadvantages. Through the addition of separate water beyond the true water content of the consolidation material in situ there are required additional process steps and increased expenses. Furthermore there occurs in this type of consolidated soil or frost protection layers so-called macro-cracks in the hardening because of shrinkage. This makes it necessary for example that relatively thick bituminous or cement bound road surfaces must be used in order to avoid the reflection of the macro-cracks in the top of the road. There is a great demand for a process for soil consolidation which can be carried out in a simpler and cheaper manner and leads to the best possible results in regard to resistance to frost, bearing strength and crack structure. Thereby it is especially desired that there be avoided macro-cracks since this would permit the use of thinner bituminous or cement bound road surfaces which in view of the scarcity and increasing price of petroleum in the future presents a continually increasing necessity.

Accordingly the present invention is based on the problem of developing a process for soil consolidation and frost protective layers produced thereby, especially for road and railroad construction, which in contrast to the conventional soil consolidation with cement can be carried out in a simple manner and in a given case using lesser amounts of cement and water. Furthermore the process of the invention should lead to a reduced formation of macro-cracks so that for example in the building of roads there can be used thinner bituminous or cement bound road surfaces.

SUMMARY OF THE INVENTION

Therefore the object of the invention is a process for soil consolidation in which the moisture containing soil to be consolidated, rubbish or a soil/rubbish mixture is mixed with cement and then compressed which is characterized by adding additional fluidizing agent to the composition to be consolidated.

The object of a preferred form of the invention is a process as stated above which is characterized by using a natural moisture containing soil and not increasing this moisture content.

It is known to use additives such as concrete fluidizers, concrete accelerators, air void formers, sealing agents, concrete retarders and compressing aids as well as additives such as mineral materials, organic materials and coloring agents in the production of concrete. In the consolidation of soil, however, these kinds of additives or additional materials with the exception of mineral materials (rubbish), however, have not been used previously. It has now been found surprisingly that the use of fluidizing agents such as concrete fluidizers and/or concrete flow agents also lead to advantageous results in soil consolidation in spite of the completely different supported proportions. Thus for example with unchanged cement content there can be eliminated the addition of separate water, i.e. the moisture of the material to be consolidated itself is sufficient. Furthermore the addition of fluidizing agents leads to higher compression strengths so that it is possible to substantially lower the cement content. From the reduction of the water and cement content in turn there results a reduced cracking behavior of the consolidated composition so that at the same or high compressive strengths macro-cracks, as was previously customary, no longer occur. Rather in the soil consolidations of the invention there is observed at most a micro-crack content. This also permits, in contrast to the previous soil consolidation with cement, the use of thinner bituminous or cement bound road surfaces, which additional to savings in the soil solidification itself leads to a further reduction in cost in the building of roads.

Concrete fluidizers (plasticizing agents) have been developed predominantly in Germany and Switzerland for several decades. Their function is to change a stiff, fresh concrete without greater addition of water into a plastic fresh concrete in order to obtain the higher compression strength of the stiff concrete on the one hand while on the other hand to profit by the many advantages of the plastic concrete. Before the use of concrete fluidizers it was customary to obtain a plastic concrete with a larger amount of cement glue, i.e. with a higher amount of cement which in turn required a higher water content. Through the use of cement fluidizers it was possible to eliminate various negative accompanying conditions of a higher cement content such as e.g. a higher shrinkage behavior. For several years furthermore there have been concrete flow agents which represent super fluidizers in their action.

In the extensive literature there is attributed to concrete fluidizers and concrete flow agents a dispersing (distributing) action in regard to the cement particles. The effect of the dispersion of the cement particles is thereby explained by a reduction of the attractive forces which the individual, water encased cement particles exert on each other. The result of this is that a balling together and the flocculation of the cement particles resulting therefrom is prevented or eliminated. In the final but subsequent setting of the cement particles, however, there is obtained a very much tighter packing than in the case of the bulky flock structure. Furthermore considering the reduced surface tension of the water through the fluidizing material the effect of fluidizers and flow agents is frequently so described that they act to a certain extent as lubricants and reduce the inner abrasion of the cement mixture. There can thus be ascribed to the concrete fluidizers and concrete flow agents a type of "lubricating action". For the comprehension of this phenomenon finally there should also be considered that the fluidizing agent influences the colloid structure inside the cement glue.

The rubbish material likewise usable in the soil consolidation according to today's technological knowledge increases the apparent cohesion on a fresh set basis in the fresh condition of the soil consolidation according to the compression attained. Besides certain known fine minerals are latent hydraulics, i.e. they take part to a certain degree through the Portland cement-clinker-constituents in the hardening behavior so that there is possible a reduction of the cement as "crack controller" component of the system.

As fluidizers and flow agents according to the state of the art there serve in the production of concrete essentially the following substances:

1. Preparations from sulfite waste liquors (lignin sulfonic acids on their salts, e.g. sodium lignin sulfonate and calcium lignin sulfonate), 2. carboxylic and hydroxycarboxylic acids, as well as their salts, e.g. tartaric acid and citric acid, their sodium and potassium salts, derivatives of these compounds and detergents, 3. specific silicones, 4. sulfonated melamine-formaldehyde condensation product (super fluidizer, flow agent), 5. condensation products of naphthalene sulfonic acid and formaldehyde, e.g. the sodium, lithium and potassium salts of such condensation products, (super fluidizer, flow agent), 6. preparations from types of sugar which are occasionally combined with calcium chlocride because of their retarding of the hardening process, 7. condensation products of anthracene analogous to naphthalene, e.g. condensation products of anthracene-sulfonic acid and formaldehyde and the sodium salt thereof, 8. sulfonated phenol-formaldehyde condensates and 9. combinations of the materials noted in Groups 1 through 8.

In practice for the production of concrete there is used 0.2 to a maximum of 1.5% concrete fluidizer solution based on the cement component. Based on the limited solubility there is generally used hereby about 20 to 30% solutions. Larger amounts of these additives generally bring no additional advantages but lead to a too strong fludification, deaeration with road concretes and to an undesirably long delay in hardening. In Germany, the use of concrete fluidizers and concrete flow agents conforms to DIN 1045 in cement concrete.

The development of the "cement stone", i.e. the materials in type and amount as well as distribution of these materials within the concrete mixture which contribute to the development are determinative of the future properties of the structural material concrete. All reactions between cement and water as well as additives and additional materials are accomplished under the prerequisite of a continuously present aqueous phase. The knowledge of the water cement values makes possible a measured volume of water sufficient for the cement. Fluidizers and flow agents in the continuously present aqueous phase can deploy their full effect up to the beginning of solidification. It is evident from the literature that the saving in water in using concrete fluidizers and concrete flow agents is between about 5 to 15%. This value is also confirmed through new investigations.

The "clinker phases" ($C_3S$, $C_2S$, $C_4(AF)$ and $C_3A$) contained in the cement react with water forming calcium silicate hydrates of to the type of Tobermorite ($5CaO \times 6SiO_2 \times 5H_2O$). Analogously the following compounds are formed from the mentioned clinker phases: tricalcium silicate hydrate, dicalcium silicate hydrate, tetracalcium aluminate ferrihydrate and tricalcium aluminum hydrate. These chemical reactions come about through the action of water on the outer membrane of each cement particle. The hydration proceeds with gel formation. Thereby water continuously penetrates through the gel into the center of the cement particle and thus causes continuously increasing gel formation. Research work has shown that there results from the gel formation an increase in volume of more than around double the original particle volume. There is also enclosed in the gel water and gel pores or voids. After thorough hydration of each cement particle takes place there has formed a system of water rich crystals of calcium silicate hydrate and calcium aluminate hydrate which also includes calcium hydroxide crystals and unhydrated clinker portions as well as voids.

As already mentioned above the adjustment of the water cement value permits a "sure of one's aim" concrete production, i.e. the strength properties correspond to expectations. Thereby the porosity of the cement stone exerts the greatest influence on its strength properties.

Although it is assumed that the "clinker phases" of the cement in soil consolidation with cement acts similar to the concrete production with water in the reciprocal action, there is in contrast to cement in the soil consolidation several serious differences. While the additive materials A, B, C according to DIN 1045 show surfaces of about 0.8 to 4.6 $m^2/kg$, the sieve lines of consolidating sands and soils proceed in further intervals to the concrete sieve lines into the fine to middle particle range. A specific surface can only be estimated with approximately 10.0 $m^2/kg$. Because of the very much smaller volume portion of the cement glue (cement + water) in soil consolidation the amount of cement glue present in soil consolidation has a very much larger surface compared to that in concrete. From this there results the already mentioned higher voild voumes in soil consolidation. Furthermore the result of the relatively small amount of cement glue in soil consolidation is that the distribution cannot be continuously present in the entire soil system. This leads in soil consolidation compositions to "point shaped cementing" of the soil particles with cement glue. Because of the deficiency of the dispersing agent water as carrier for the cement as the disperse phase cement particle aggregates form in numerous points of particle packing. Because of the agglomeration of cement particles to larger aggregates the thorough hydration of a large cement packing proceeds with gel formation always becoming firmer and volume increase always slower, but always advancing. This is one of the reasons for the frequent finding of fault of late strengths after large periods of time.

It has now been surprisingly found that in using concrete fluidizers and/or concrete flow agents in soil consolidation compositions the water portion can be reduced to about 70 liters/$m^3$ and yet there be obtained a building material sufficiently capable of compaction, although in soil consolidation compositions previously for a by far larger surface (in comparision to concrete) there is available a substantially lesser amount of cement glue and the smaller water content no longer guarantees the continuity of the liquid phase within the building material mixture of soil solidifcation. Flow agent materials not only exert a dispersing effect on the cement particles but their effect also extends to the finest components of the soil.

The carrying out of the operation has resulted in making possible a savings in water of up to 50%, based on the "optimal water content". Surprisingly, however, useful results are only produced at very much higher concentrations of fluidizer and/or flow agent than are customary in the production of concrete. There have proven suitable amounts of 2.5 to 5% and preferably 3 to 4.5% of dry material in powder form based on the cement content.

The concrete fluidizers and concrete flow agents can be employed as dry materials, i.e. in powder form. In contrast in the production of flowable concrete according to DIN 1045 there are permitted only liquid concrete flow agents. The fluidizers and flow agents, however, also can be added in liquid form, in which case such amounts are used that there are obtained the concentrations given above based on the dry material. They can be sprayed in liquid form before the addition of cement to the ground surface or filled into the mixer or in powder form together with the cement or separately by means of scattering devices for the cement scattered on the ground surface or added into the mixture or even be intensively mixed with the cement before the application to the soil being consolidated.

As suitable materials for fluidization in tests there have proven particularly useful sulfonated naphthalene formaldehyde condensates, e.g. the sodium salts of such condensates. The other customary fludizing agents then can only be used if there no longer appear previously established injurious conditions to the hardening process and no changes in space (expansions). In this connection the high sugar content frequently found in commercial concrete fluidizers and concrete flow agents particularly has a perceptible negative effect (see below).

The possibility of saving about 50% of the water has great economical and industrial advantages. The economical advantages are that most rough grades of streets and paths employing the soil consolidation no longer require prewetting. Consequently the manufacturing of watering devices can be eliminated. A greater industrial advantage is that because of the use of greatly reduced amounts of moisture the shrinkage or crack formation behavior is likewise greatly reduced. From the pertinent literature it is known that the crack formations in soil consolidation layers is only influenced in slight measure by higher compression strength. To a much greater extent the cracks form on account of the shrinkage behavior because of the capillarity of fine particled compositions. In the soil consolidations according to the invention the shrinkage crack formation is greatly reduced up to formation of micro-cracks or is stopped entirely, if it is possible to greatly reduce the industrially normally necessary water saturation value.

Furthermore through the use of the fluidizing agents of the invention there are obtained higher compression strengths. It is assumed that this rests on the use of lesser water content in the use of fluidizing agent, since in the point form cementing of cement stone substantially less gel voids are contained than in using the optimum water content, and additionally it can be traced back to the chemical nature of the fluidizing agents and its effect on the hardening cement stone. While soil solidification without addition of fluidizers has accumulations of cement particle aggregates in the cementing points, these apparently are dispersed, distributed and thus activated with the utilization of the fluidization material. From the higher compression strengths producible according to the invention in turn there results an additional economical advantage in such a way that in comparison with a normal case there is possible a saving in cement without loss of strength.

Finally it is assumed that the "water deficiency" of soil consolidation compositions of the invention implies the formation of calcium silicate hydrates of lower water form as well as a reduced portion of gel voids, which are caused by the moisture. Also through this the cement stone in the cementing points of the soil solidification should be less void containing and therefore of increased strength.

Of the rubbish (or trash) materials usable in the soil consolidation particularly fly ash is likely to have a great significance in the future since it is obtained in large amounts and until now could only be introduced to a small extent in meaningful use. Investigations carried out in the space of the invention have indeed shown that the possibilities of including fly ash in the soil consolidation greatly depend on its properties. As suitable evaluation criterion there has proven in the previous experiments the size of the loss on ignition. Accordingly fly ashes can be roughly divided into three classes 1. Fly Ash Having Test Certificates Under this heading according to "Richtlinie fur die Erteilung von Prufzeichen fur Steinkohlenflugsache als Betonzusatzstoff nach DIN 1045" (Test certificate directions), September 1979 is understood a fly ash, which in specific investigations was harmless as a concrete additive as well as also having a specific uniformity in its chemical nature. The loss on ignition, i.e. the unburned coke portion, in no individual value is permitted to exceed 5.0 weight %. Furthermore there results for sulfate, chloride, the Blaine value, the particle portion 0.02 mm and 0.04 mm fixed limiting values. This type of fly ash occurs for example in the coal power plant Kiel-East.

2. Fly Ash Without Test Certificates

Under this is understood any fly ashes having ignition losses between 5 and 8 weight %. This type of fly ash is obtained for example in the coal power plant Wedel and is used, e.g. as filler in material to be mixed with asphalt.

3. Fly Ash With Ignition Loss Above 8%

In this class are fly ashes from coal power plants with moderate or poor degrees of combustion or overaged boiler plants. The loss on ignition with these fly ashes can amount to 40 weight % and more.

Best suited for the process of the invention is fly ash 1 which be used alone or mixed in any desired portion with soil. Suitable amounts of fly ash in admixture with soil are at 30 to 70% and especially at about 50%. Fly ash 2 can only be used alone in soil consolidation in exceptional cases. However, fly ash 2 can usually be added to the soil being consolidated in an amount up to 60% and preferably 40 to 50%. Fly ash 3 also is not suited alone for the soil solidifcation, but can be added to soil being solidified in amounts up to 20%. Reference is made in this connection, however, that the previously mentioned proportionate amounts of the various fly ashes are aimed that the soil consolidation produced satisfies the requirements of TVV 74. If higher or lower requirements are placed on the soil consolidation then there are especially changed the amounts of addition of fly ashes 2 and 3 which are possible.

The embodiments in the description and in the following examples are essentially aimed at the requirements given in TVV 74. However, it is understood that the process of the invention is not limited to fulfilling these requirements but it is within the pleasure of one of ordinary skill in the art with deviating demands to correspondingly adjust the process of the invention.

Unless otherwise indicated all parts and percentages are by weight.

In the examples the cement was Portland cement unless otherwise indicated.

The process of the invention can comprise, consist essentially of or consist of the stated steps with the materials set forth.

DETAILED DESCRIPTION

EXAMPLE 1

Figure 1:
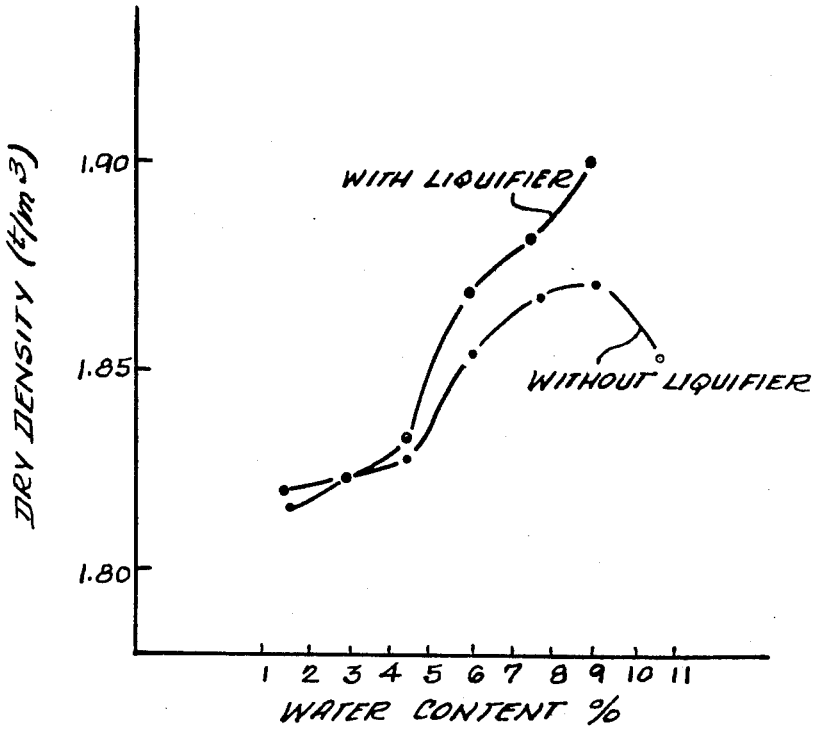
FIGS. 1 through 4 are graphs of dry density vs. water content.

There was first investigated a specific soil at a cement content of 7% standard according to Proctor. For this purpose the soil taken was air dried over several days. Subsequently the investigation according to Proctor began from a water content of about 1.0 to 1.5%. The water content was gradually increased, each time 1.5% and carried above the optimum point. The final water content was 10.5%. The Proctor investigation carried out over 7 moisture steps gave for the representative soil a Proctor value of 1.87 g/cm$^3$ and an optimal water content of 9.0%.

There were subsequently carried out Proctor investigations with the same soil material with the same moisture content steps but with the addition of fluidizers and flow agents in powder form in dosages between 2.5% and 5% based on the cement content of the sample. It was found that water contents between 3.0 and 4.5% already gave dry-space densitities which lay in the vicinity of 100% Proctor density (standard case). At water contents of above 4.5% these materials even showed Proctor densitities of far above 100%.

Compression strength tests subsequently carried out on Proctor cylinders gave higher strengths than normal soil consolidation compositions i.e. soil consolidation compositions produced without addition of fluidizers.

EXAMPLE 2

There was investigated according to Proctor a sand (sand taken from canal marsh; frost protection sand SE according to DIN 18196, Soil F1) with addition of 7% of cement and 2.5% of fluidizer, based on the cement content. There were obtained the Proctor curves seen in FIG. 1.

The fluidizer employed was a ligninsulfonate (i.e. sodium ligninsulfonate). The dosage recommendation of the manufacturer (thought for cement) was exceeded about 10 times. As can be seen from the Proctor curves produced in FIG. 1, there was observed a clear increase of the dry density.

With samples having 5% of fluidizer, based on the cement, there was likewise observed a good fluidification effect. Because of the very high sugar content of the ligninsulfonate used and the retardation of hardening connected therewith there were not ascertained it is true any usable compression strength values after 7 days.

EXAMPLE 3

The experiment according to Example 2 was repeated using two further fluidizing agents. The fluidizing agent B consisted of a combination of lignin sulfonates (sodium lignin sulfonates) and melamine-formaldehyde condensates. The fluidizing agent C consisted of a combination of lignin sulfonates (sodium ligninsulfonate) and naphthalenesulfonate formaldehyde condensate sodium salt of naphthalenesulfonate-formaldehyde condensate. The two fluidizing agents were employed, in each case in an amount of 2.5 and 5%, based on the amount of cement. The dry densities obtained according to Proctor are set forth in FIGS. 2 and 3.

Figure 2:
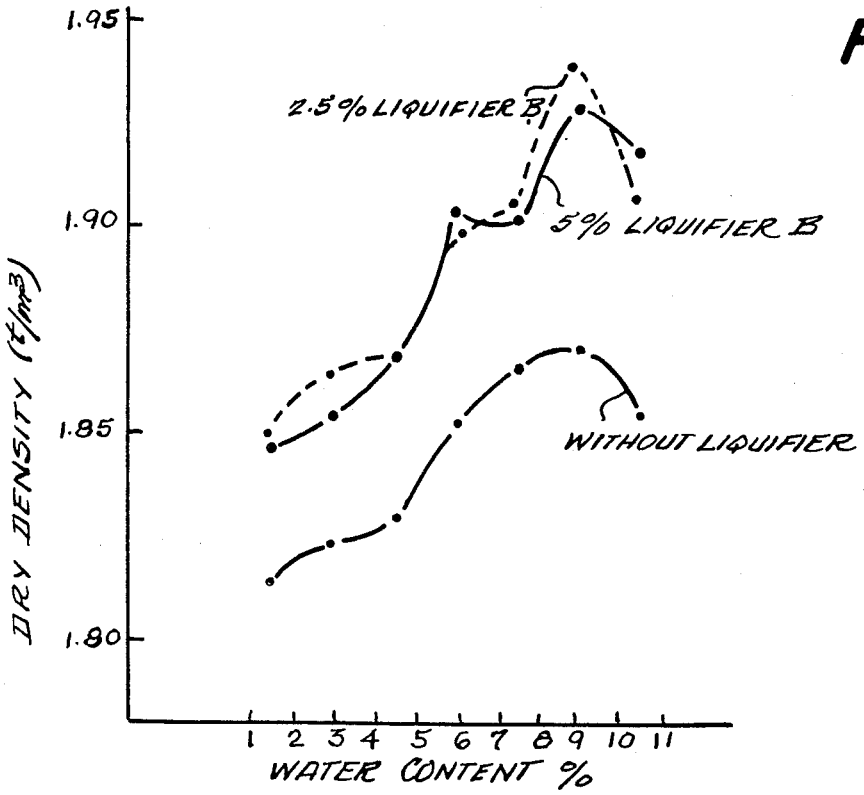
Figure 3:
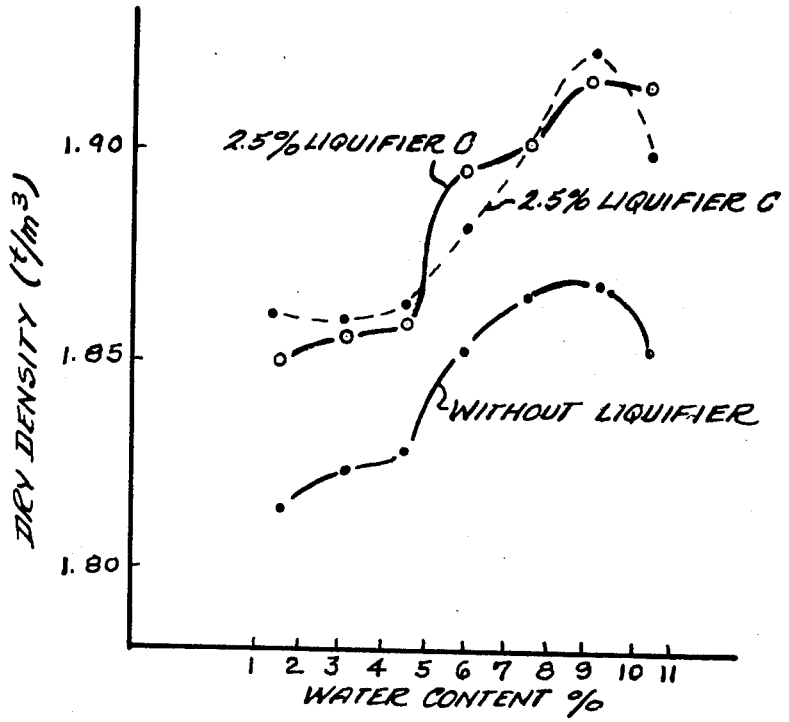

The fluidizing effect observed was very good (compare FIGS. 2 and 3). Because of the high sugar content of the ligninsulfonate the compression strength results obtained were only partially satisfactory.

EXAMPLE 4

Figure 4:
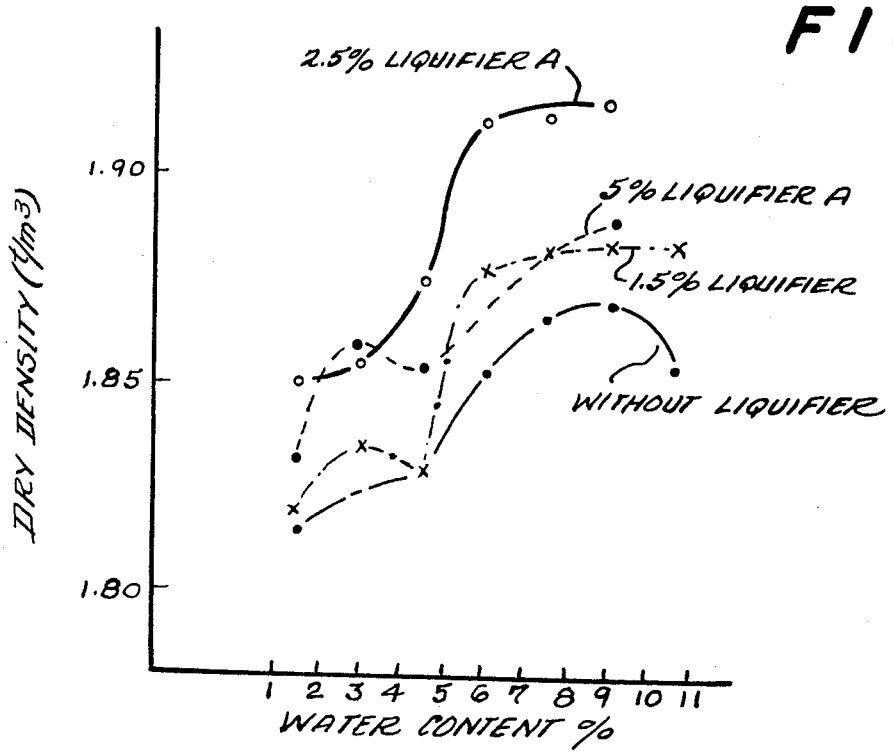

The experiment of Example 2 was repeated using a sulfonated naphthalene-formaldehyde condensate (as the sodium salt) (fluidizer A) as the fluidizing agent. The fluidizing agent was employed in an amount of 1.5, 2.5 and 5.0% based on the cement. The Proctor curves obtained are repeated in FIG. 4.

The results show that already at a water content of about 3 to 4.5% there is obtained the lowest necessary density of 98% of the standard Proctor density for the soil consolidation.

The investigation of samples having a water content of 4.5% gave about ⅓ higher compressive strength values (after 7 days) than for corresponding samples without addition of fluidizer. This shows that the cement content using fluidizers compared to the "standards" soil consolidation with cement can be reduced about ⅓ (see Example 6).

EXAMPLE 5

It has been emphasized several times in the foregoing description that concrete is produced with a very small residual void portion while in the soil consolidation the void portion is 10 to 20 times that of concrete voids. From the literature and applicants' own investigations it can be seen that soil consolidation can be considered as frost safe, if there is attained a compressive strength of 2.5 N/mm$^2$ in the structural unit. In contrast to concrete this considerably lower minimum compression strength is based on the fact that even in water storage a test body of soil consolidation material far from takes up the amounts of water which it can take up based on its void volume. Therefore sufficient void space is available in the formation of ice for the change in volume from water to ice (9% increase).

Figure 5:
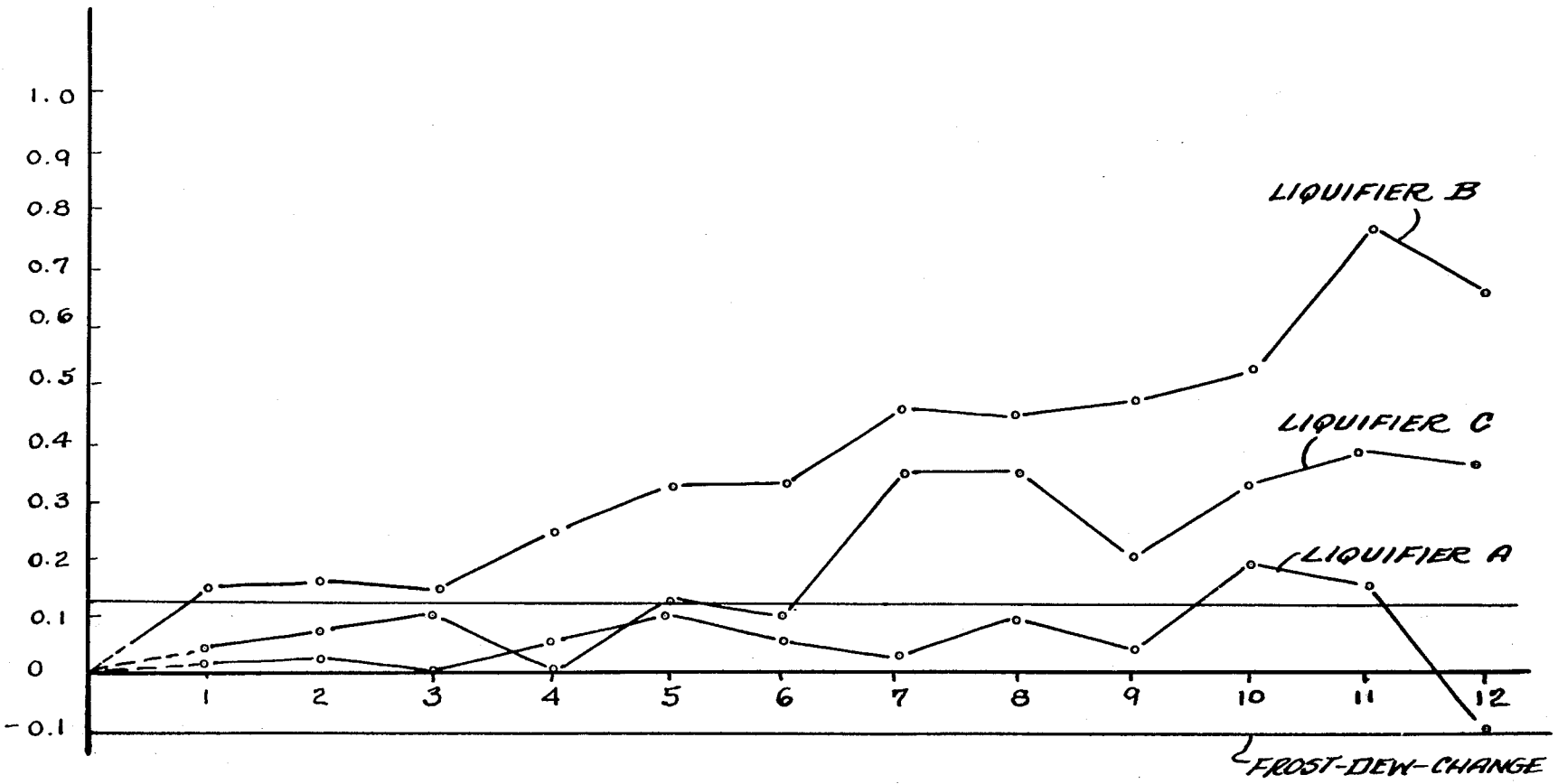
FIG. 5 is a graph of frost-thaw changes using the Proctor-test cylinder.

In order to investigate the influence of frost in the frost-thaw cyclic process or test bodies having the dosages of fluidizing and flow agent materials set forth in Examples 3 and 4 there were produced Proctor-test cylinders having 7% Pectacrete cement. Since the test cylinders after 7 days had a compression strength of about 5 N/mm$^2$, the investigation began according to the pamphlet for "Eignungsprufungen bei Bodenverfestigung mit Zement", (Qualification tests in Soil Consolidation With Cement), Forschungsgesellschaft fur das Strassenwesen, Arbeitsgruppe Untergrund-Unterbau, 1975 edition, paragraph 4,4,3—frost testing. In modifying paragraph 4,4,3 not only was the test value of the change in length between the first and after the twelfth given but the lengthwise change was ascertained after each action of frost in order to make more visible the development process of tne lifting of frost. After the end of 12 frost-thaw cycles the experiments were stopped and the test data evaluated in a graphic representation (see FIG. 5).

The test bodies in each case contained 2.5% of fluidizer A, B or C based on the cement. The height of the Proctor test cylinder was 12 cm. The permissible change in length after the 12th frost-thaw change is 1%. 1% of 12 cm is 0.12 mm.

Furthermore there were determined the compression strength of the test cylinder after 7 and 28 days as well as after the end of the frost-thaw cycle. The results are collected in the following table.

| | Compression Strength in N/mm$^2$ | | |
|---|---|---|---|
| | Fluidizer A | Fluidizer B | Fluidizer C |
| After 7 days (without frost) | 5.9 | 2.3 | 5.5 |
| After 28 days (without frost) | 9.9 | 8.6 | 6.2 |
| After 12 Frost-thaw-changes | 7.2 | 2.9 | 2.9 |

The results obtained show that in the addition of all three fluidizing agents there were obtained usable compression strength values. In regard to the change in length after frost-thaw changes only fluidizer A gave the required change in length of less than 1%, namely a change in length of below 0.1 mm. As can also be seen from the compression strength values in using fluidizers B and C the high sugar content in fluidizers B and C also had a noticeably negative effect in the frost-thaw changes investigation.

EXAMPLE 6

In Example 4 it was mentioned that the addition of fluidizers led to about ⅓ higher compression strength values so that the cement content in using fluidizers in contrast to the "standard" soil solidification with cement can be reduced around ⅓. In order to show this a clean sand "SE" according to DIN 18196 and ZTV StB 76 was investigated according to Proctor. In this case first the cement content was changed at constant water content of 4.5%. At a cement content of 4.6% there was found a dry density according to Proctor of 1.840 and a compression strength after seven days of 2.4 N/mm$^2$, while at a cement content of 7.0% the dry density according to Proctor amounted to 1.871 and the compression strength after seven days 4.5 N/mm$^2$. These results confirm the above statement that the increase in strength is in about a linear relationship with the increase of the cement content.

Furthermore there was investigated samples having a content of 4.5% water, 4.6% cement and, based on the cement portion, 3% of fluidizer A. There was found a dry-space density of 1.898 and a compression strength after seven days of 4.4 N/mm$^2$. This shows that the addition of fluidizer actually permits a saving of about ⅓ of the cement without hurting the compression strength.

In the space of the experiments carried out there were also investigation samples which at a water content of 4.5% only contained the stated amount of fluidizer A but no cement. It showed that the addition of fluidizer A alone already resulted in a better compression i.e. a higher dry-space density in the Proctor test. This confirms the fact that the fluidizing agent not only exerts a dispersing effect on the cement particles but also on the finest components of the soil (see above).

EXAMPLE 7

There were carried out several series of tests with unwashed sand 0/8 mm (sand SE according to DIN 18196) with addition of fly ashes 1, 2 and 3 which have been explained in the description. Fly ash 1 originates in the coal power plant Kiel-East, fly ash 2 from the coal power plant Wedel and fly ash 3 from the coal power plants Tiefstaak and Neuhof, Hamburg. There were ascertained the Proctor curves for various composition.

Test A: There was ascertained the Proctor curve for sand with addition of 4 parts by weight cement to 100 parts by weight sand. Thereby there resulted a maximum dry density of 1.919.

Test B: There were ascertained the Proctor curves for compositions of 100 parts by weight sand, 2 parts by weight cement and 4 parts by weight of fly ash. Thereby in each case there were carried out tests without addition of fluidizing agent and with fluidizing agent (3% based on the cement). The maximum dry densities attained are repeated in the following table.

Test C: Test B was repeated with the difference that 4 parts by weight of cement were used. The maximal dry densities obtained are likewise given in the following table.

Test D: Test C was repeated with the difference that the portion of fly ash was increased to 15 parts by weight. The results likewise are repeated in the following table.

Test E: Test D was repeated with the difference that the portion of fly ash was increased to 30 parts by weight. The results likewise are repeated in the following table.

Test F: Test E was repeated with the difference that the portion of fly ash was increased to 50 parts by weight. The results likewise are set forth in the following table.

| | Dry Density (g/cm³) | | | | | |
|---|---|---|---|---|---|---|
| | Fly Ash 1 | | Fly Ash 2 | | Fly Ash 3 | |
| Test | o.V. | m.V. | o.V. | m.V. | o.V. | m.V. |
| B | 1.931 | 1.960 | 1.922 | 1.951 | — | — |
| C | 1.964 | 1.984 | 1.933 | 1.969 | — | — |
| D | 2.028 | 2.068 | 1.993 | 2.035 | 1.950 | 1.977 |
| E | 2.034 | 2.057 | 1.977 | 1.997 | 1.839 | 1.850 |
| F | 1.962 | 2.000 | 1.899 | — | — | — |

In the table "o.V." indicates without fluidizer and "m.V." indicates with fluidizer.

The mixture with fly ash 1 in using the powdery fluidizing agent possesses the highest dry-space densities. Without use of fluidizer powder, the densities are clearly lower. The mixture with fly ash 2 shows essentially the same dry density differences, but generally the dry densities are somewhat below the dry densities of the mixture with fly ash 1. The fly ash 3 behaves strongly different than the two previously mentioned fly ashes, as the dry densities of the mixture with an economically interesting fly ash portion of above 15 parts by weight are greatly reduced. Lower dry densities are related to high void portion and generally also with weaker compression strength properties. Corresponding Proctor tests carried out with steel plate inserts showed that the particle shattering was greatest with fly ash 3. It was established that generally with lowering of the dry density and simultaneously increasing fly ash portion the particle shattering appears to decrease.

Summarizing it is recognizable based on the above Proctor investigations that fly ashes with a combustible residue (loss on firing) of about 3% (fly ash 1) have good properties even in higher mixing proportions, fly ashes with a firing loss of up to about 8% exhibit somewhat less favorable properties and fly ashes having firing losses above 10% have more unfavorable properties on the development of the dry density.

Proctor test cylinders were produced with several base recipes to ascertain the compression strengths after 7 and 28 days. In all base recipes the sand portion was 100 parts by weight and the water portion 4.5 parts by weight.

The amount of fluidizer-powder is constant at 3%, based on the cement content. In each case there were produced test cylinders having 3.5 and 7 parts by weight of cement, based on the sand and fly ash. From the graphic representation of the compression strength values obtained as a function of the cement portion there was ascertained each cement requirement which resulted in sufficient compression strength for the requirements of TVV 74. The base recipes used contained the following amounts of fly ash.

Base recipe A: 4 parts by weight fly ash 1
Base recipe B: 4 parts by weight fly ash 2
Base recipe C: 15 parts by weight fly ash 1
Base recipe D: 30 parts by weight fly ash 1
Base recipe E: 30 parts by weight fly ash 3
Base recipe F: 15 parts by weight fly ash 3

| Base Recipe | 3 GT Cement | 5 GT Cement | 7 GT Cement | Cement Requirement According to TVV 74 in GT Cement |
|---|---|---|---|---|
| | Compression Strength After 7 Days (N/mm²) | | | |
| A | 3.2 | 6.2 | 11.0 | 3.55 |
| B | 2.7 | 6.3 | 9.5 | 3.80 |
| C | 3.8 | 5.5[1] | — | 3.20 |
| D | 2.9 | 4.4 | — | 4.50 |
| E | 0.8[2] | 1.0[3] | — | —[4] |
| F | 2.0 | 4.5 | — | 4.60 |
| | Compression Strength 28 Days (N/mm²) | | | |
| A | 3.9 | 9.9 | 13.8 | 3.72 |
| B | 3.8 | 8.6 | 11.7 | 3.90 |
| C | 6.2 | 12.6[1] | — | 2.96 |
| D | 6.0 | 8.9 | — | 3.00 |
| E | 0.9[2] | 2.3[3] | — | —[4] |
| F | 3.0 | 7.9 | — | 4.35 |

1. Cement portion is 4.35 parts by weight
2. Cement portion is 2.30 parts by weight
3. Cement portion is 3.85 parts by weight
4. The compression strengths obtained were below the requirements according to TVV 74

The results reproduced in the above table show that on the basis of 7 or 28 day compression strength measured on the requirements of TVV 74 there occurs with increasing portion of fly ash considerable difference in the amounts of cement required. This makes it clear that the latent hydraulic properties of the fly ash can lead to higher post hardening. Fly ash 1 at a mixing portion of 30 parts by weight to 100 parts by weight of sand using a fluidizer powder needs only 3 parts by weight of cement, i.e. thus less than about 50% of the customary cement portion according to the state of the art. However, if fly ash 1 is used in a portion of only 4 parts by weight to 100 parts by weight of sand then the cement requirement only increases to 3.5 to 3.7 parts by weight.

Mixtures with 4 parts by weight of fly ash 2 allow the cement requirement to increase only a trifling amount to 3.8 to 3.9 parts by weight. Even the qualitatively poorest fly ash, namely fly ash 3 can still be used in a portion of 15 parts by weight, in which case the cement requirement increases to about 4.5 parts by weight. On the contrary mixtures with portions of 30 parts by weight of fly ash 3 behave unfavorably since they exhibit insufficient strength properties.

Of note it is be emphasized that all cement requirement amounts are derived from strength properties on the basis of 4.5 parts of water in the soil consolidation composition. This is an extremely important prerequisite, jointly with a relatively low cement requirement, for a substantially crack free soil consolidation-coating construction.

EXAMPLE 8

In order to investigate the influence of limestone powder as a dusty product basic composition in a soil consolidation mixture, there were again first carried out Proctor tests for the purpose of ascertaining the influence of the mineral materials on each other as well as tests with and without the use of fluidizer powder. Here also as previously different Proctor curves were shown, i.e. that with the same recipes the Proctor curve with fluidizer powder was above the Proctor curve without fluidizer powder. Tests with a base recipe carried out for the determination of the compression strength of test bodies after 7 and 28 days (see Example 7) gave similar results to those in Example 7, whereby the cement requirement based on the compression strength required according to TVV 74 after 7 days was 3.80 parts by weight and based on the compression strength required according to TVV 74 after 28 days was 4.14 parts by weight. The base recipe consisted of 100 parts by weight of sand and 15 parts by weight limestone powder. The fluidizer powder portion was constant at 3%, based on the cement. Here also there resulted a considerably lower cement requirement, namely at a water content of about 50% of the optimum water content. This enormous savings of water must always be considered in the evaluation of all reported results.

The same kind of experiments were carried out using clay-bond silica brick powder. There were obtained corresponding results, whereby e.g. using 15 parts by weight of the clay-bond silica brick powder to 100 parts by weight of sand (sand SE according to DIN 18196) there resulted a cement requirement according to the requirements of TVV 74 after 7 days of 3.85 parts by weight.

EXAMPLE 9

Test bodies of the compositions according to Examples 7 and 8 were investigated in the frost-thaw cyclic process in the manner described in Example 5. Only the sand-fly ash mixtures whose Proctor cylinder after 7 days had compression strengths of below 2.0 to 2.5 $N/mm^2$ showed changes in length going beyond 1% $\theta$. All the remaining samples, even those with the highest amounts of limestone powder gave changes of length within the permissible range.

Indeed the investigations with silica brick powder represent a phenomenon which in contrast to all the other experiments did not result in a slight increase in length but instead there was a slight decrease in length. This decrease in length, however, in all cases is below 1% $\theta$ (0.12 mm).

Summarizing it is established that only the initial strength of the soil consolidation, but not the portion of most finely divided mineral material can be the cause for frost damage.

To examine the influence of the frost-thaw cycle the test bodies were investigated in connection with their compression strength. Thereby the result was that no test body showed a drop in compression strength which would indicate that a strength damaging influence had occurred through frost. Rather the test bodies tested after the influence of frost showed in the average value different higher values for compression strength in comparison to the standard 28 day compression strength results. Accordingly the evidence shows that the increase of the finest portions 0.06 mm in soil consolidation compositions leads to no frost damaging influence on the structural parts of soil consolidation.

EXAMPLE 10

Supplementing Examples 7 to 9 fly ashes without admixing sand therewith were subjected alone to Proctor investigations. There were carried out in each case tests with and without addition of fluidizer powder. While fly ash 3 using 6 or 10 parts by weight of cement to 100 parts by weight of fly ash with and without fluidizers gave practically unusable results, the addition of fluidizer powder with fly ash 2 leads to a clear increase of the dry density and the compression strengths. The dry densities with fly ash 1 were still substantially higher than with fly ash 2. Here also the addition of fluidizing agents leads to a strong increase of the compression strengths.

It appears that soil consolidation compositions which consist only of fly ash and cement exhibit no clear Proctor value. The increase of the curve of the dry density leads to a highest value which is related to the passing out of water during the carrying out of the tests. The comparison of all the fly ashes indicates that the higher the loss on ignition the higher is the water requirement.

Fly ashes have a certain capacity for taking up water. Upon contact with moisture there immediately form spherical clumps of various sizes which work in opposition to a homogenization with cement and additive. Therefore it is suitable to dry mix the fly ash cement with powdery fluidizing agent and only subsequently to add moisture. In this way it is possible to homogenize fly ash, cement and fluidizer powder. There certainly must be considered that dry fly ash take up about 3 parts by weight of water itself which then apparently does not participate in the compression process of the soil consolidation composition.

For compression strength determinations there were first produced soil consolidation mixtures of fly ash and about 7 parts by weight of water. In preliminary tests the cement was stirred into the previously moistened fly ash, one with fluidizer powder and one without fluidizer. The Proctor test cylinders produced were only with great difficulty forced out of the Proctor form, apparently because of the higher jacket friction and showed horizontal cracks in the test bodies. Thereupon there was given up a testing of the compression strength (see above).

In modification the previously described procedure cement was then mixed into the fly ash with and without fluidizer powder. Only after this was water added. This mode of action led to easier processing and to greater intervals of results between the compositions with and without fluidizer powder.

The tests with fly ash 1 showed that with a water portion of 50% of the maximum water requirement the use of fluidizing agent led to a reduction of the cement requirement of about 35 to 40%. With raising of the water content to the maximum water content of about 16 parts by weight there resulted an increase of the compression strength. In turn this makes possible the use of very much lower amounts of cement. However, it should be noted that the probability of the formation of cracks increases with the possibility of higher evolution of moisture from the soil solidification coating. As already stated in the preceding examples the cement requirement was determined based on the criteria of TVV 74.

In all of the described examples there was used hydrophobized cement (Pectacrete-cement). In Examples 7 to 10 as the powdery fluidizing agent there was employed sulfonated naphthaleneformaldehyde condensate (as the sodium salt).

The entire disclosure of German priority application P 3028670.5 is hereby incorporated by reference.

The process can comprise, consist essentially of or consist of the steps set forth with the stated materials and the compositions can comprise, consist essentially of or consist of the stated materials.

Unless otherwise indicated all parts and percentages are by weight.

What is claimed is:

1. In a process for the consolidation of soil in which moisture containing soil, rubbish or a mixture of soil and rubbish is mixed with cement and then compressed to form the consolidated soil the improvement comprising adding as the sole additive a fluidizing agent to the composition to be consolidated, said fluidizing agent being the amount of fluidizing agent based on the dry material being 2.5 to 5%, based on the cement content of the composition.

2. A process according to claim 1 wherein there is employed 3 to 4.5% of the fluidizing agent.

3. A process according to claim 2 wherein the amount of cement required to give a desired compression strength of the consolidated soil in the absence of the fluidizing agent is determined and there is employed in the fluidizing agent containing composition $\frac{1}{3}$ less cement than that determined and the fluidizing agent containing soil is then consolidated to give a consolidated soil having said desired compression strength.

4. A process according to claim 1 wherein the soil is free from rubbish.

5. A process according to claim 1 wherein the soil is mixed with rubbish.

6. A process according to claim 1 wherein there is employed rubbish without soil.

7. A process according to claim 1 wherein there is employed soil mixed with fly ash or fly ash alone.

8. A process according to claim 7 wherein the fly ash has a loss on ignition of not over 5%.

9. A process according to claim 8 wherein the fly ash is used alone.

10. A process according to claim 8 wherein there is used a mixture of soil and fly ash containing 30 to 70% of fly ash.

11. A process according to claim 7 wherein there is used a mixture of soil and fly ash, the fly ash having a loss on ignition between 5 and 8%, and being present in an amount up to 60% of the total of soil and fly ash.

12. A process according to claim 7 wherein there is used a mixture of soil and fly ash, the fly ash having a loss on ignition of above 8% and being present in an amount up to 20% of the total of soil and fly ash.

13. A process according to claim 7 wherein soil consolidation composition contains about 70 liters/$m^3$ of water.

14. A composition comprising the consolidated soil prepared by the process of claim 1.

15. A composition comprising the consolidated soil prepared by the process of claim 2.

16. A composition comprising the consolidated soil prepared by the process of claim 3.

17. A composition comprising the consolidated soil prepared by the process of claim 4.

18. A composition comprising the consolidated soil prepared by the process of claim 7.

19. A composition comprising the consolidated soil prepared by the process of claim 8.

20. A composition comprising the consolidated soil prepared by the process of claim 9.

21. A composition comprising the consolidated soil prepared by the process of claim 10.

22. A composition comprising the consolidated soil prepared by the process of claim 11.

23. A composition comprising the consolidated soil prepared by the process of claim 12.

24. A composition comprising the consolidated soil prepared by the process of claim 13.

25. A composition comprising the consolidated soil prepared by the process of claim 5.

* * * * *